US012313308B2

(12) United States Patent
Hirayama et al.

(10) Patent No.: US 12,313,308 B2
(45) Date of Patent: May 27, 2025

(54) ROTARY COMPRESSOR AND REFRIGERATION CYCLE DEVICE

(71) Applicant: Carrier Japan Corporation, Tokyo (JP)

(72) Inventors: Takuya Hirayama, Fuji (JP); Shogo Shida, Fuji (JP); Taishi Nagahata, Fuji (JP); Hayato Toda, Fuji (JP); Tomoaki Kurita, Fuji (JP)

(73) Assignee: Carrier Japan Corporation, Tokyo (JP)

( * ) Notice: Subject to any disclaimer, the term of this patent is extended or adjusted under 35 U.S.C. 154(b) by 226 days.

(21) Appl. No.: 17/943,392

(22) Filed: Sep. 13, 2022

(65) Prior Publication Data

US 2023/0003427 A1 Jan. 5, 2023

Related U.S. Application Data

(63) Continuation of application No. PCT/JP2020/012444, filed on Mar. 19, 2020.

(51) Int. Cl.
*F04C 29/02* (2006.01)
*F04C 15/00* (2006.01)
(Continued)

(52) U.S. Cl.
CPC ..... *F25B 31/026* (2013.01); *F04C 15/0023* (2013.01); *F04C 15/003* (2013.01); *F04C 15/0038* (2013.01); *F25B 13/00* (2013.01)

(58) Field of Classification Search
CPC ..... F25B 31/026; F25B 13/00; F04C 29/023; F04C 15/0023; F04C 15/003; F04C 15/0038
See application file for complete search history.

(56) References Cited

U.S. PATENT DOCUMENTS 6,195,889 B1 * 3/2001 Gannaway ..... F01C 21/108 29/888.025
2006/0171833 A1 8/2006 Sato

FOREIGN PATENT DOCUMENTS

CN 109154297 A 1/2019
JP 6-81789 A 3/1994
(Continued)

OTHER PUBLICATIONS

International Search Report issued Jun. 9, 2020 in PCT/JP2020/012444 filed on Mar. 19, 2020, 4 pages (with English Translation).
(Continued)

*Primary Examiner* — Deming Wan
(74) *Attorney, Agent, or Firm* — Oblon, McClelland, Maier & Neustadt, L.L.P.

(57) ABSTRACT

A rotary compressor of an embodiment has a rotating shaft, an electric motor, a compression mechanism, a balancer, and a balancer cover. The compression mechanism has a cylinder, a main bearing, and a sub-bearing. The balancer is provided on the rotating shaft on a second side of the sub-bearing in an axial direction thereof. The balancer cover covers the balancer. A lubricating oil supply path that opens on a second side end face in the axial direction is provided in the rotating shaft. A supply hole that allows the supply path to communicate with the outside of the balancer cover is formed in the balancer cover at a position facing the supply path in the axial direction. A seal mechanism that seals between the balancer cover and the rotating shaft is provided between the balancer cover and the rotating shaft while allowing relative movement between the balancer cover and the rotating shaft in the axial direction.

13 Claims, 8 Drawing Sheets

(51) Int. Cl.
*F25B 13/00* (2006.01)
*F25B 31/02* (2006.01)

(56) References Cited

FOREIGN PATENT DOCUMENTS

| | | | |
|---|---|---|---|
| JP | 10-238482 | A | 9/1998 |
| JP | 2003-343452 | A | 12/2003 |
| JP | 2006-207532 | A | 8/2006 |
| JP | 2018-165502 | A | 10/2018 |
| JP | 2019-002497 | A | 1/2019 |

OTHER PUBLICATIONS

Combined Chinese Office Action and Search Report issued Dec. 22, 2023 in Chinese Application 202080098502.6, (with English translation), 22 pages.

* cited by examiner

ROTARY COMPRESSOR AND REFRIGERATION CYCLE DEVICE

CROSS-REFERENCE TO RELATED APPLICATION

This is a Continuation Application of International Application No. PCT/JP2020/012444, filed on Mar. 19, 2020, and the entire contents of the aforementioned application are incorporated herein by reference.

FIELD

An embodiment of the present invention relates to a rotary compressor and a refrigeration cycle device.

BACKGROUND

A rotary compressor is used for a refrigeration cycle device such as an air conditioner. In a rotary compressor, a refrigerant is compressed due to eccentric rotation of an eccentric portion of a rotating shaft in a compression mechanism.

In this type of rotary compressor, in order to inhibit whirling of the rotating shaft due to a centrifugal force generated at the eccentric portion, for example, a balancer may be provided at a portion of the rotating shaft located below the compression mechanism (for example, refer to Japanese Unexamined Patent Application, First Publication No. 2018-165502). The balancer is covered with a balancer cover from below. However, a conventional rotary compressor still has room for improvement in terms of inhibiting leakage of the refrigerant from the inside of the balancer cover.

DETAILED DESCRIPTION

Figure 1:
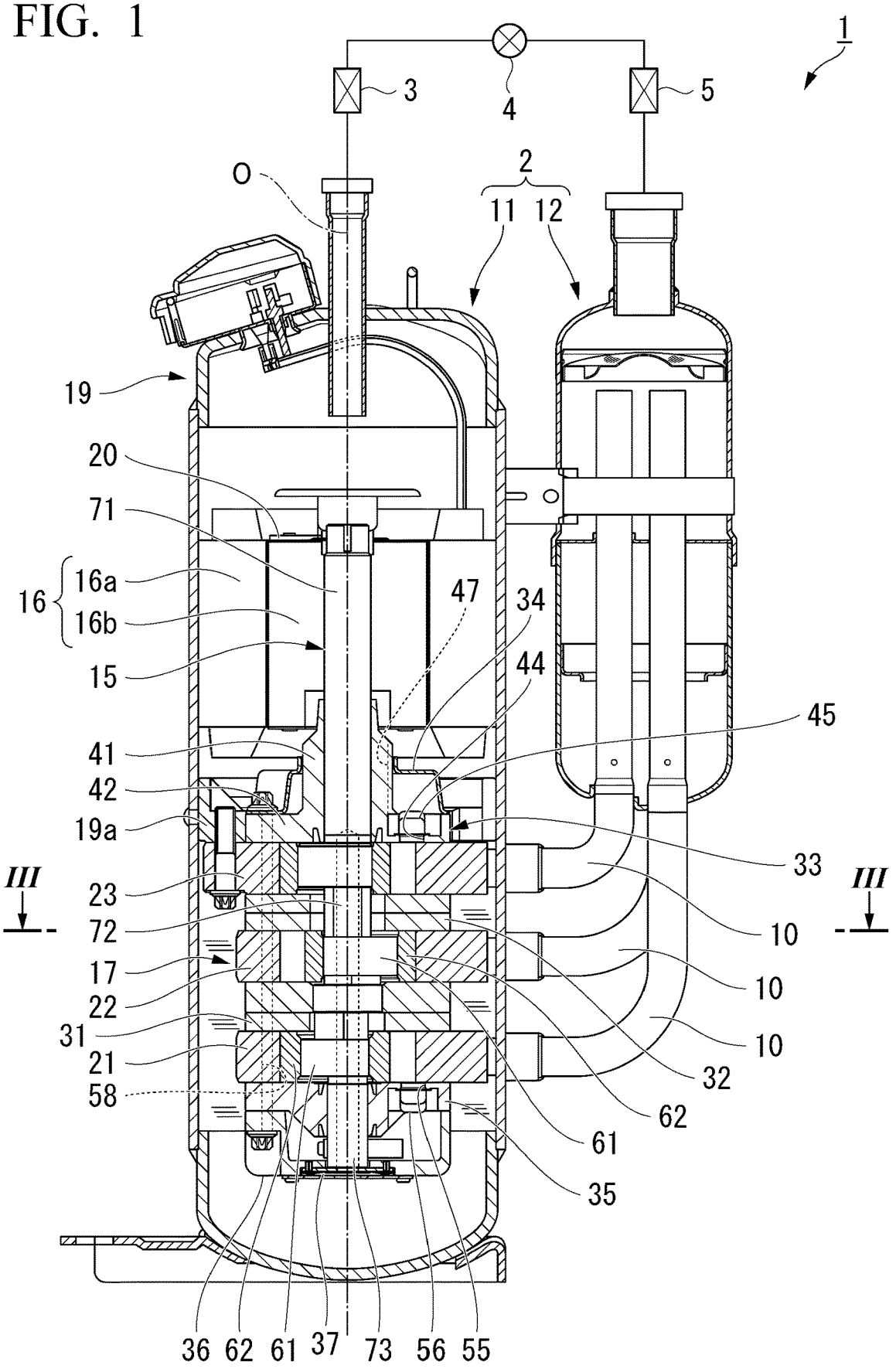
FIG. 1 is a schematic configuration diagram of a refrigeration cycle device, which includes a cross-sectional view of a rotary compressor according to a first embodiment.

A rotary compressor of an embodiment includes a rotating shaft, an electric motor, a compression mechanism, a balancer, and a balancer cover. The rotating shaft includes an eccentric portion. The electric motor is disposed on a first side of the rotating shaft in an axial direction thereof to rotate the rotating shaft. The compression mechanism is disposed on a second side of the rotating shaft in the axial direction. The compression mechanism includes a cylinder, a main bearing, and a sub-bearing. The main bearing is provided on the first side in the axial direction with respect to the cylinder. The sub-bearing is provided on the second side in the axial direction with respect to the cylinder. The balancer is provided on the rotating shaft on the second side of the sub-bearing in the axial direction. The balancer cover covers the balancer. A lubricating oil supply path that opens on a second side end face in the axial direction is formed in the rotating shaft. A supply hole that allows the supply path to communicate with the outside of the balancer cover is formed in the balancer cover at a position facing the supply path in the axial direction. A seal mechanism that seals between the balancer cover and the rotating shaft is provided between the balancer cover and the rotating shaft while allowing relative movement between the balancer cover and the rotating shaft in the axial direction.

A rotary compressor and a refrigeration cycle device of embodiments will be described below with reference to the drawings. In the following description, in each of the above-mentioned embodiments, the same or corresponding configurations may be denoted by the same reference numerals, and description thereof may be omitted. In the embodiments and modified examples described below, corresponding configurations may be denoted by the same reference numerals, and description thereof may be omitted. Also, in the following description, for example, expressions indicating relative or absolute arrangements such as "parallel," "perpendicular," "central," "coaxial," and the like represent not only such arrangements strictly, but also include relative displacement with tolerances or with angles and distances that provide the same functions.

First Embodiment

First, a refrigeration cycle device 1 will be briefly described. FIG. 1 is a schematic configuration diagram of the refrigeration cycle device 1, which includes a cross-sectional view of a rotary compressor 2 according to a first embodiment.

As shown in FIG. 1, the refrigeration cycle device 1 of the present embodiment includes the rotary compressor 2, a condenser 3 serving as a radiator connected to the rotary compressor 2, an expansion device 4 connected to the condenser 3, and an evaporator 5 serving as a heat sink connected between the expansion device 4 and the rotary compressor 2.

The rotary compressor 2 is a so-called rotary compressor. The rotary compressor 2 compresses a low pressure gaseous refrigerant taken therein into a high temperature and high pressure gaseous refrigerant. Also, a specific configuration of the rotary compressor 2 will be described later.

The condenser 3 radiates heat from the high temperature and high pressure gaseous refrigerant sent from the rotary compressor 2 to convert it into a high pressure liquid refrigerant.

The expansion device 4 reduces a pressure of the high pressure liquid refrigerant sent from the condenser 3 to convert it into a low temperature and low pressure liquid refrigerant.

The evaporator 5 evaporates the low temperature and low pressure liquid refrigerant sent from the expansion device 4 to convert the low temperature and low pressure liquid refrigerant into a low pressure gaseous refrigerant. Then, in the evaporator 5, when the low pressure liquid refrigerant evaporates, it absorbs heat of vaporization from surroundings, thereby cooling the surroundings. Also, the low pressure gaseous refrigerant that has passed through the evaporator 5 is taken in the rotary compressor 2 described above.

In this way, in the refrigeration cycle device 1 of the present embodiment, the refrigerant, which is a working fluid, circulates while undergoing a phase change between the gaseous refrigerant and the liquid refrigerant. Also, in the refrigeration cycle device 1 of the present embodiment, for the refrigerant, an HFC refrigerant such as R410A or R32, an HFO refrigerant such as R1234yf or R1234ze, or a natural refrigerant such as $CO_2$ can be used.

Next, the above-described rotary compressor 2 will be described.

The rotary compressor 2 of the present embodiment includes a compressor body 11 and an accumulator 12.

The accumulator 12 is a so-called gas-liquid separator. The accumulator 12 is provided between the above-described evaporator 5 and the compressor body 11. The accumulator 12 is connected to the compressor body 11 through suction pipes 10. The accumulator 12 supplies only the gaseous refrigerant to the compressor body 11 among the gaseous refrigerant vaporized by the evaporator 5 and the liquid refrigerant not vaporized by the evaporator 5.

The compressor body 11 includes a rotating shaft 15, an electric motor 16, a compression mechanism 17, and a sealed container 19 that houses the rotating shaft 15, the electric motor 16, and the compression mechanism 17.

The sealed container 19 is formed in a cylindrical shape and both end portions in a direction of an axis O thereof are closed. Lubricating oil is contained in the sealed container 19. A portion of the compression mechanism 17 is immersed in the lubricating oil.

The rotating shaft 15 is disposed coaxially along the axis O of the sealed container 19. Also, in the following description, a direction along the axis O is simply referred to as an axial direction, a direction orthogonal to the axial direction is referred to as a radial direction, and a direction around the axis O is referred to as a circumferential direction.

The electric motor 16 is disposed on a first side in the axial direction inside the sealed container 19. The compression mechanism 17 is disposed on a second side in the axial direction inside the sealed container 19. In the following description, the electric motor 16 side (first side) in the axial direction is referred to as an upper side, and the compression mechanism 17 side (second side) is referred to as a lower side.

The electric motor 16 is a so-called inner rotor type DC brushless motor. Specifically, the electric motor 16 includes a stator 16*a* and a rotor 16*b*.

The stator 16*a* is fixed to an inner wall surface of the sealed container 19 by shrink fitting or the like.

The rotor 16*b* is fixed to an upper portion of the rotating shaft 15 while disposed on an inner side of stator 16*a* with an interval therebetween in the radial direction.

A balancer 20 is provided on an upper surface of the rotor 16*b*. The balancer 20 is formed, for example, in an arc shape in a plan view in the axial direction. The balancer 20 is provided on a portion of the upper surface of the rotor 16*b* in the circumferential direction. Also, the balancer 20 may be provided on a lower surface of the rotor 16*b*.

The compression mechanism 17 is fixed inside the sealed container 19 via a frame 19*a* fixed to an inner circumferential surface of the sealed container 19. The compression mechanism 17 is a three-cylinder compression mechanism having three cylinders 21, 22, and 23, for example. The compression mechanism 17 includes the cylinders 21 to 23 described above, a plurality of partition plates 31 and 32, a main bearing 33, a muffler 34, a sub-bearing 35, a balancer cover 36, and a seal mechanism 37.

In the present embodiment, the cylinders 21 to 23 are the first cylinder 21, the second cylinder 22, and the third cylinder 23. The first cylinder 21, the second cylinder 22 and the third cylinder 23 are disposed side by side in order from bottom to top. Each of the cylinders 21 to 23 is formed in a cylindrical shape that is open in the axial direction. Each of the cylinders 21 to 23 is disposed coaxially with the rotating shaft 15.

The lower partition plate 31 of the partition plates 31 and 32 is disposed between the first cylinder 21 and the second cylinder 22 and closes an upper end opening portion of the first cylinder 21 and a lower end opening portion of the second cylinder 22. The upper partition plate 32 is disposed between the second cylinder 22 and the third cylinder 23 and closes an upper end opening portion of the second cylinder 22 and a lower end opening portion of the third cylinder 23. The lower partition plate 31 and the upper partition plate 32 are formed in annular shapes in a plan view in the axial direction. The rotating shaft 15 penetrates an inner side of each of the partition plates 31 and 32.

The main bearing 33 is disposed above the third cylinder 23 and closes an upper end opening portion of the third cylinder 23. The main bearing 33 rotatably supports a portion of the rotating shaft 15 located above the third cylinder 23 (a main shaft portion 71, which will be described later). Specifically, the main bearing 33 includes a cylindrical portion 41 through which the rotating shaft 15 is inserted, and a flange portion 42 provided to protrude outward in the radial direction from a lower end portion of the cylindrical portion 41.

A main bearing discharge hole 44 that penetrates the flange portion 42 in the axial direction is formed in a portion of the flange portion 42 in the circumferential direction. The main bearing discharge hole 44 communicates with the inside of the third cylinder 23. Also, a discharge valve mechanism 45 is disposed in the flange portion 42.

The muffler 34 covers the main bearing 33 from above. A discharge port 47 that allows communication between the inside and the outside of the muffler 34 is formed in a central portion of the muffler 34 in the radial direction. The high temperature and high pressure gaseous refrigerant discharged through the main bearing discharge hole 44 is discharged into the sealed container 19 through the discharge port 47.

Figure 2:
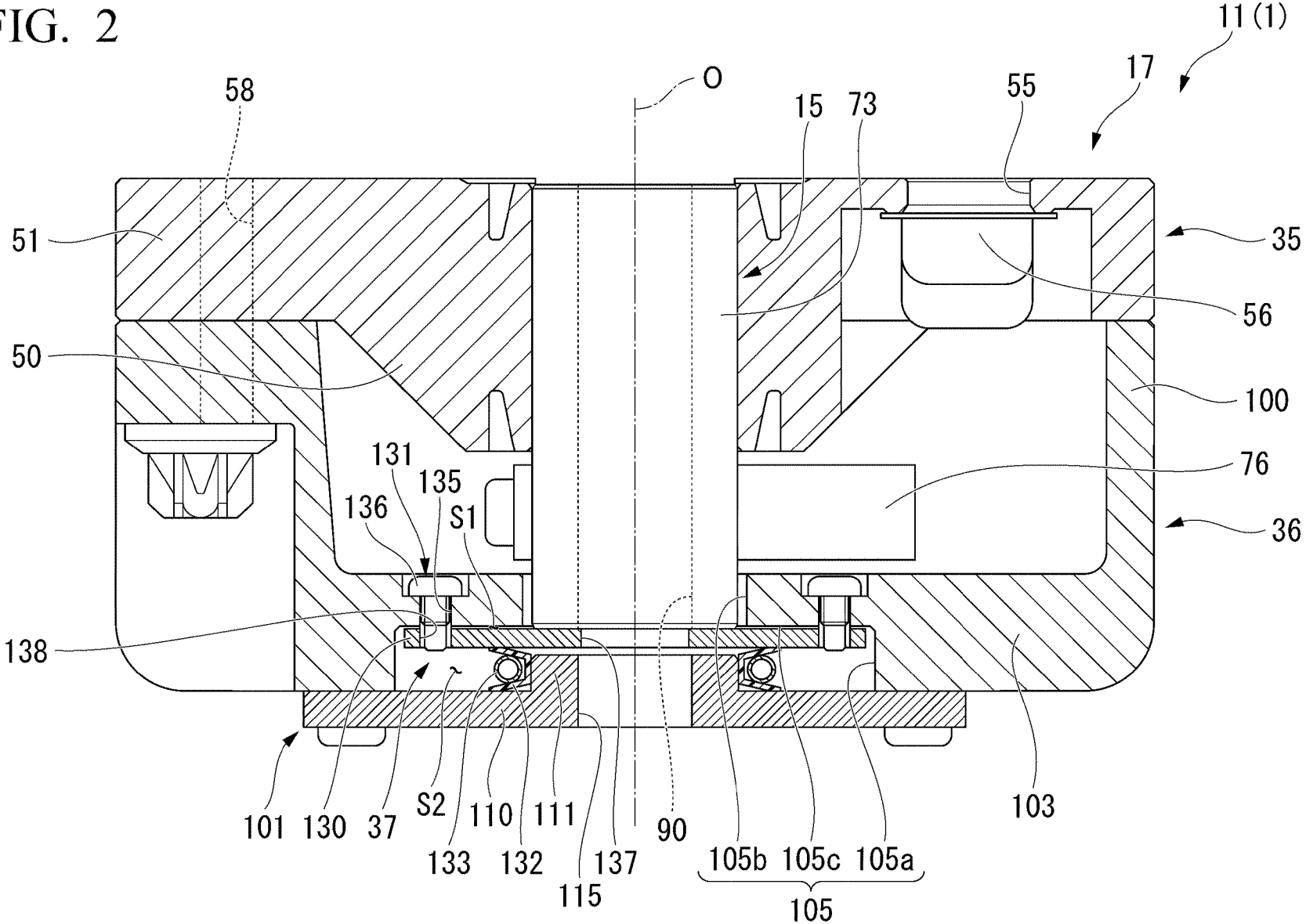
FIG. 2 is a partial cross-sectional view of the rotary compressor according to the first embodiment.

FIG. 2 is a partial cross-sectional view of the rotary compressor 2 according to the first embodiment.

As shown in FIG. 2, the sub-bearing 35 closes a lower end opening portion of the first cylinder 21. The sub-bearing 35 rotatably supports a portion of the rotating shaft 15 located below the first cylinder 21 (a sub-shaft portion 73, which will be described later). Specifically, the sub-bearing 35 includes a cylindrical portion 50 through which the rotating shaft 15 is inserted, and a flange portion 51 provided to protrude outward in the radial direction from an upper end portion of the cylindrical portion 50.

A sub-bearing discharge hole 55 that penetrates the flange portion 51 in the axial direction is formed in a portion of the flange portion 51 in the circumferential direction. The sub-bearing discharge hole 55 communicates with the inside of the first cylinder 21. Also, a discharge valve mechanism 56 is disposed on the flange portion 51.

The balancer cover 36 covers the sub-bearing 35 from below. Also, details of the balancer cover 36 and a peripheral structure of the balancer cover 36 will be described later.

As shown in FIG. 1, in the compression mechanism 17 of the present embodiment, a communication path 58 is formed to allow the inside of the balancer cover 36 to communicate with the inside of the muffler 34. The communication path 58 penetrates the cylinders 21 to 23, the partition plates 31 and 32, and the bearings 33 and 35 in the axial direction.

In the present embodiment, a space surrounded by the sub-bearing 35, the first cylinder 21 and the lower partition plate 31 constitutes a first cylinder chamber. As a pressure in the first cylinder chamber increases, the sub-bearing discharge hole 55 opens, and thus a refrigerant in the first cylinder chamber is discharged outside the first cylinder chamber (inside the balancer cover 36). The refrigerant discharged outside the first cylinder chamber flows into the muffler 34 through the communication path 58.

A space surrounded by the lower partition plate 31, the second cylinder 22, and the upper partition plate 32 constitutes a second cylinder chamber. As pressure in the second cylinder chamber increases, for example, a discharge hole (not shown) formed in the lower partition plate 31 opens, and thus a refrigerant in the second cylinder chamber is discharged outside the second cylinder chamber. The refrigerant discharged outside the second cylinder chamber flows into the communication path 58 through a communication path (not shown) formed in the lower partition plate 31 and then into the muffler 34.

A space surrounded by the main bearing 33, the third cylinder 23, and the upper partition plate 32 constitutes a third cylinder chamber. As a pressure in the third cylinder chamber increases, the main bearing discharge hole 44 opens, and thus a refrigerant in the third cylinder chamber is discharged outside the third cylinder chamber (into the muffler 34). Also, the refrigerant in the muffler 34 is discharged into the sealed container 19 through the discharge port 47.

Figure 3:
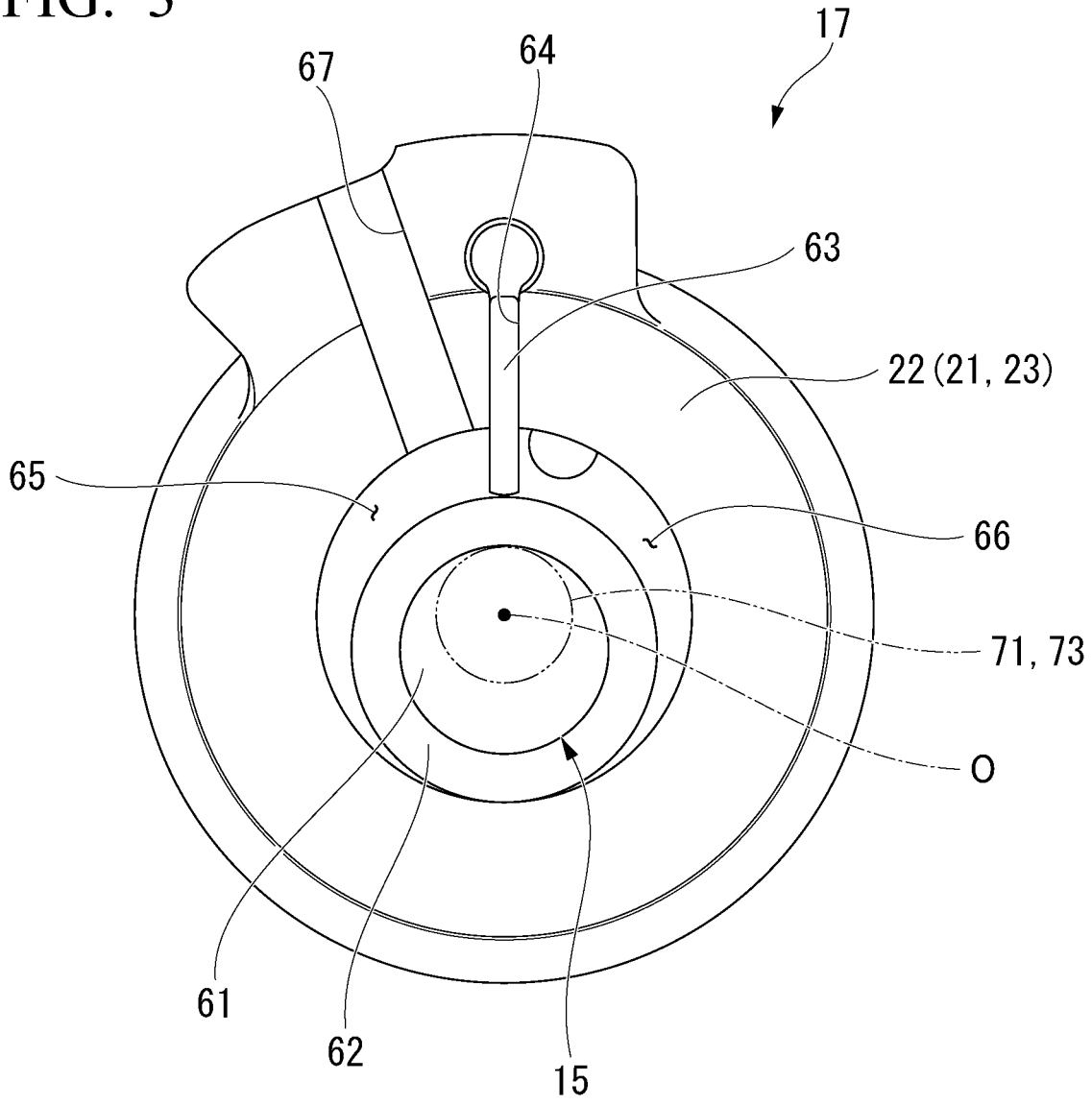
FIG. 3 is a cross-sectional view of a compression mechanism corresponding to line in FIG. 1.

Next, internal configurations and operations of the cylinder chambers will be described. FIG. 3 is a cross-sectional view of the compression mechanism 17 corresponding to line III-III in FIG. 1. An internal configuration of the second cylinder chamber will be described below as a representative. Internal configurations of the first cylinder chamber and the third cylinder chamber are the same as the internal configuration of the second cylinder chamber, except for a direction of eccentricity of an eccentric portion 61.

As shown in FIG. 3, the eccentric portion 61, a roller 62, and a vane 63 are provided in the second cylinder chamber.

The eccentric portion 61 is integrally formed with the rotating shaft 15. The eccentric portion 61 is radially eccentric with respect to the axis O of the rotating shaft 15. The direction of eccentricity of the eccentric portion 61 of each cylinder chamber differs by 120° in the circumferential direction.

The roller 62 is formed in a cylindrical shape. The eccentric portion 61 is inserted into the roller 62.

The vane 63 is housed in a vane groove 64 formed in the second cylinder 22. The vane groove 64 is open on an inner circumferential surface of the second cylinder 22 in a portion of the second cylinder 22 in the circumferential direction. The vane 63 is configured to be slidable in the radial direction, and advances into and retreats from the inside of the second cylinder chamber. The vane 63 is pushed radially inward by a pressing member (not shown) to come into contact with an outer circumferential surface of the roller 62. The vane 63 partitions the inside of the second cylinder chamber into a suction chamber 65 and a compression chamber 66 in the circumferential direction.

A suction hole 67 is formed in the second cylinder 22 to allow the inside of the suction chamber 65 to communicate with the inside of the suction pipe 10. In the second cylinder chamber, as the rotating shaft 15 rotates, the roller 62 rotates eccentrically with respect to the axis O while its outer circumferential surface is in sliding contact with the inner circumferential surface of the second cylinder 22. As the roller 62 rotates eccentrically, a suction operation is performed to suck a gaseous refrigerant into the suction chamber 65. Further, as the roller 62 rotates eccentrically, a compression operation is performed to compress the gaseous refrigerant in the compression chamber 66. The compressed gas refrigerant is discharged outside the second cylinder chamber as described above.

As shown in FIG. 1, the rotating shaft 15 includes the main shaft portion 71, a driving portion 72, and the sub-shaft portion 73.

The main shaft portion 71 is a portion of the rotating shaft 15 located above the third cylinder 23. The main shaft portion 71 is disposed coaxially with the axis O. The above-described rotor **16*b* is fixed to an upper end portion of the main shaft portion 71 (a portion located above the main bearing 33**).

The driving portion 72 penetrates the cylinders 21 to 23 in the axial direction. The driving portion 72 includes the eccentric portion 61 described above. A plurality of (for example, three) eccentric portions 61 are provided at intervals in the axial direction corresponding to each of the cylinders 21 to 23.

As shown in FIG. 2, the sub-shaft portion 73 is a portion of the rotating shaft 15 located below the first cylinder 21. The sub-shaft portion 73 is disposed coaxially with the axis O. A lower end portion of the sub-shaft portion 73 protrudes downward from the sub-bearing 35. A balancer 76 is provided at the lower end portion of the sub-shaft portion 73.

The balancer 76 is fixed to the lower end portion of the sub-shaft portion 73 while being radially eccentric with respect to the axis O. Positions and weights of the balancers 20 and 76 are set such that a sum of a moment acting on the rotating shaft 15 on the basis of a centrifugal force acting on each of the eccentric portions 61 and a moment acting on the rotating shaft 15 on the basis of a centrifugal force acting on each of the balancers 20 and 76 becomes zero. Thus, whirling of the rotating shaft 15 is inhibited.

A supply path 90 for supplying lubricating oil to each sliding portion (for example, between the eccentric portion 61 and the roller 62) in the compression mechanism 17 is formed on the rotating shaft 15. The supply path 90 extends coaxially with the axis O. A lower end portion of the supply path 90 is open at a lower end surface of the rotating shaft 15. Also, a play is set for the rotating shaft 15, which allows it to be vertically displaceable with respect to the compression mechanism 17 when vibrations, pressure fluctuations, or the like occur with the rotation.

An upper end portion of the supply path 90 terminates at a lower end portion of the main shaft portion 71. However, a length of the supply path 90 in the axial direction can be appropriately changed as long as it is configured to reach at least the cylinders 21 to 23. For example, the supply path 90 may pass through the rotating shaft 15 in the axial direction. Further, a twisted plate or the like may be provided on an inner circumferential surface of the supply path 90 to promote rising of the lubricating oil as the rotating shaft 15 rotates.

A branch flow path (not shown) is connected to the supply path 90. The branch flow path extends in the rotating shaft 15 in the radial direction. The branch flow path is open at a connection portion between the eccentric portion 61 and the roller 62, a sliding portion between the main shaft portion 71 and the main bearing 33, and a sliding portion between the sub-shaft portion 73 and the sub-bearing 35 on an outer circumferential surface of the rotating shaft 15. Also, a position, a shape, and the like of the branch flow path can be appropriately changed as long as it has the configuration in which the lubricating oil flowing through the supply path 90 is supplied to sliding portions to be lubricated.

Next, the balancer cover 36 and the seal mechanism 37 will be described.

The balancer cover 36 includes a cover body 100 and a lid member 101.

The cover body 100 is formed in a bottomed cylindrical shape that opens upward. An outer circumferential portion of the cover body 100 is fastened to the sub-bearing 35 with, for example, bolts, thereby covering the sub-bearing 35 from below. A through hole 105 passing through a bottom wall 103 is formed at a position of the bottom wall 103 of the cover body 100 that overlaps the axis O in a plan view. The through hole 105 is formed in a stepped shape, whose inner diameter decreases toward the upper side. That is, the through hole 105 includes a large diameter portion 105*a* located on the lower side, and a small diameter portion (an entrance hole) 105*b* located above and continuous with the large diameter portion 105*a*.

In the present embodiment, a lower end portion of the rotating shaft 15 passes through the small diameter portion 105*b*. Specifically, the rotating shaft 15 is set such that, even when the maximum upward displacement of vertical displacements of the rotating shaft 15 relative to the compression mechanism 17 occurs, a lower end face of the rotating shaft 15 is located below a stepped surface 105*c* formed by the large diameter portion 105*a* and the small diameter portion 105*b* on an inner surface of the through hole 105.

The lid member 101 is attached to the cover body 100 from below to cover the through hole 105. The lid member 101 includes a base plate 110, and a protruding portion 111 that protrudes upward from the base plate 110.

The base plate 110 has a disc shape larger than the large diameter portion 105*a*. The base plate 110 is fixed to the cover body 100 by fastening its outer circumferential portion to the bottom wall 103 of the cover body 100 with bolts or the like.

The protruding portion 111 is disposed coaxially with the axis O. The protruding portion 111 is hosed within the large diameter portion 105*a*. In the illustrated example, an upper end face of the protruding portion 111 is located below the small diameter portion 105*b*.

A supply hole 115 that penetrates the base plate 110 and the protruding portion 111 in the axial direction is formed in a portion of the lid member 101 located on the axis O. The supply hole 115 has an inner diameter equivalent to that of the supply path 90 described above and faces the supply path 90 in the axial direction.

The seal mechanism 37 blocks communication between the inside and the outside of the balancer cover 36 through the through hole 105 (small diameter portion 105*b*) between the cover body 100 and the lid member 101. Specifically, the seal mechanism 37 includes a thrust plate (intermediate member) 130, detent portions 131, a seal member 132, and a pressing member 133.

The thrust plate 130 is hosed in the large diameter portion 105*a*. Specifically, the thrust plate 130 is formed in a disc shape with an outer diameter smaller than the inner diameter of the large diameter portion 105*a*. A communication hole 137 that penetrates the thrust plate 130 in the axial direction is formed in a portion of the thrust plate 130 located on the axis O. The communication hole 137 allows the inside of the supply path 90 to communicate with the inside of the supply hole 115. That is, the supply path 90 communicates with the outside of the balancer cover 36 through the communication hole 137 and the supply hole 115. This allows the lubricating oil in the sealed container 19 to flow into the supply path 90 through the communication hole 137 and the supply hole 115.

A portion of an upper surface of the thrust plate 130 located outside the communication hole 137 abuts the lower end face of the rotating shaft 15 from below. Thus, a space between the rotating shaft 15 and the thrust plate 130 is sealed. In addition, inner diameters of the supply path 90, the communication hole 137, and the supply hole 115 can be changed as appropriate as long as the lower end face of the rotating shaft 15 and the thrust plate 130 are configured to abut each other, and the supply path 90 is configured to communicate with the outside of the balancer cover 36.

A thickness of the thrust plate 130 is thinner than a distance between the stepped surface 105*c* and an upper surface of the protruding portion 111 in the axial direction. Accordingly, the thrust plate 130 is configured to be movable between the stepped surface 105*c* and the protruding portion 111 in the axial direction within the through hole 105. Also, a shape of the thrust plate 130 in a plan view can be appropriately changed as long as it is configured to be movable in the axial direction within the large diameter portion 105*a*.

In the present embodiment, since the lower end face of the rotating shaft 15 is located below the stepped surface 105*c*, a gap S1 is formed between the thrust plate 130 and the stepped surface 105*c*. The gap S1 communicates with a lower space S2 of the thrust plate 130 through an outer circumferential surface of the thrust plate 130 and an inner circumferential surface of the large diameter portion 105*a*. Accordingly, the lower space S2 communicates with the inside of the balancer cover 36 through the gap S1. For that reason, a pressure in the lower space S2 is the same as that in the balancer cover 36 (a discharge pressure of the refrigerant). Also, a design of the thrust plate 130 may be appropriately changed as long as the thrust plate 130 is configured to be located in the large diameter portion 105*a* and be in contact with the lower end face of the rotating shaft 15.

The detent portions 131 are configured such that screws 136 protruding from the balancer cover 36 engage into insertion holes 138 formed in the thrust plate 130.

The screws 136 are inserted into through holes 135 formed in the bottom wall 103. Specifically, the through holes 135 penetrates portions of the bottom wall 103 located above the large diameter portion 105*a* in the axial direction. A plurality of through holes 135 are formed at intervals in the circumferential direction. The screws 136 are screwed into inner surfaces of the through holes 135 with their lower end portions protruding below the through holes 135. Accordingly, the lower end portions of the screws 136 protrude into the large diameter portion 105*a*.

The insertion holes 138 are formed in the outer circumferential portion of the thrust plate 130. A plurality of insertion holes 138 are formed at intervals in the circumferential direction corresponding to the screws 136. The lower end portions of the screws 136 (portions that protrude downward beyond the through holes 135) are separately inserted into the insertion holes 138. The screws 136 engage into inner surfaces of the insertion holes 138 in the circumferential direction. Thus, a circumferential movement of the thrust plate 130 relative to the screws 136 (balancer cover 36) is restricted with an axial movement thereof guided by the screws 136. Also, it is sufficient that the detent portions 131 are configured to be non-rotatable relative to the balancer cover 36 while the thrust plate 130 is movable in the axial direction. In this case, the detent portions 131 are not limited to the screws 136 and may be pins or the like. In addition, in the present embodiment, the configuration in which the screws 136 serving as protrusion portions are provided in the cover body 100 and the insertion holes 138 serving as recessed portions are formed in the thrust plate 130 has been described, but the present invention is not limited to this configuration. The configuration in which the cover body 100 is provided with recessed portions and the thrust plate 130 is provided with protrusion portions that engage into the recessed portions may be adopted.

The seal member 132 is, for example, a V-packing or the like. Specifically, the seal member 132 is made of an elastically deformable material such as a rubber. The seal member 132 is formed in a V shape that opens radially outward and closes radially inward in a cross-sectional view in the axial direction. In addition, although its shape is described as a V shape, it is synonymous with a U shape (or a shape). The seal member 132 is formed in a ring shape disposed coaxially with the axis O in a plan view. The protruding portion 111 described above is fitted into the seal member 132 by press fitting or the like. A tip edge of a first piece of the seal member 132 abuts a lower surface of the thrust plate 130 from below. On the other hand, a tip edge of a second piece of the seal member 132 is in contact with an upper surface of the base plate 110 from above. In other words, the seal member 132 seals between the lid member 101 and the thrust plate 130 in the axial direction. Accordingly, the seal member 132 blocks communication between the inside and the outside of the balancer cover 36 through a space between the lid member 101 and the thrust plate 130 in the large diameter portion 105*a*.

An opening side (outer side in the radial direction) of the V-shaped cross-section of the seal member 132 communicates with (faces) the inside of the balancer cover 36. Specifically, the opening side of the V-shaped cross-section of the seal member 132 communicates with an atmosphere of the refrigerant discharged from the sub-bearing discharge hole 55 due to a gap between the outer circumferential surface of the rotating shaft 15 (sub-shaft portion 73) and the small diameter portion 105*b* of the balancer cover 36, the gap between the stepped surface 105*c* and the thrust plate 130, and the like, and has an atmosphere with a pressure equivalent to that of a discharged gas. On the other hand, a closed side (inner side in the radial direction) of the V-shaped cross-section of the seal member 132 communicates with (faces) the supply hole 115. Specifically, the closed side of the V-shaped cross-section of the seal member 132 communicates with an atmosphere inside the sealed container 19 through a gap between the thrust plate 130 and the lid member 101, and the supply hole 115. The refrigerant discharged from the compression mechanism 17 communicates through the communication path 58 and the muffler 34, and thus due to the influence of pressure loss and the like, the atmosphere inside the sealed container 19 tends to be lower in pressure than the atmosphere of the refrigerant immediately after being discharged from the sub-bearing discharge hole 55. For that reason, the pressure on the opening side of the V-shaped cross-section of the seal member 132 tends to be higher than that on the closed side, and a force that presses and expands the V-shaped cross-section is applied, thereby improving the sealing performance.

The pressing member 133 is formed in a ring shape in a cross-sectional view in the axial direction and a plan view. The pressing member 133 surrounds the seal member 132 from the outside. Specifically, the pressing member 133 is fitted between the first piece and the second piece of the seal member 132 from the outside to press the first piece and the second piece away from each other in the axial direction. Accordingly, the pressing member 133 presses the thrust plate 130 upward via the seal member 132. Thus, the thrust plate 130 is configured to be movable in the vertical direction in accordance with a vertical displacement of the rotating shaft 15 while being in close contact with the lower end face of the rotating shaft 15. That is, the seal mechanism 37 of the present embodiment seals between the balancer cover 36 and the rotating shaft 15 while allowing the vertical displacement of the rotating shaft 15 with respect to the balancer cover 36.

In other words, the seal mechanism 37 seals between the supply hole 115 of the balancer cover 36 and a space surrounded by the balancer cover 36, the sub-bearing 35 and the outer circumferential surface of the rotating shaft 15. Also, the space surrounded by the balancer cover 36, the sub-bearing 35, and the outer circumferential surface of the rotating shaft 15 may be a plurality of spaces partitioned by partition plates or the like. Thus, noises caused by the refrigerant discharged from the sub-bearing discharge hole 55 can be reduced.

Next, operations of the rotary compressor 2 described above will be described.

As shown in FIG. 1, when electric power is supplied to the stator 16*a* of the electric motor 16, the rotating shaft 15 rotates around the axis O together with the rotor 16*b*. Then, as the rotating shaft 15 rotates, the eccentric portion 61 and the roller 62 rotate eccentrically within the cylinders 21 to 23. In this case, the roller 62 is in sliding contact with the inner circumferential surface of each of the cylinders 21 to 23. Thus, the gaseous refrigerant is taken into the cylinder chambers through the suction pipes 10, and the gaseous refrigerant taken into the cylinder chambers is compressed.

After being discharged from the cylinder chambers, the compressed gaseous refrigerant flows into the muffler 34 directly or indirectly through the communication path 58, and then the gaseous refrigerant discharged into the sealed container 19 through the discharge port 47 of the muffler 34 is sent to the condenser 3 as described above.

Incidentally, a pressure equivalent to the discharge pressure of the refrigerant acts on the lubricating oil inside the sealed container 19. For that reason, the lubricating oil flows into the supply path 90 through the supply hole 115 and the communication hole 137. The lubricating oil that has flowed into the supply path 90 is raised in the supply path 90 due to a centrifugal force caused by the rotation of the rotating shaft 15, and then distributed to the branch flow path. The lubricating oil distributed to the branch flow path is discharged onto the outer circumferential surface of the rotating shaft 15 and supplied to each sliding portion. Thus, the lubricating oil serves to lubricate each sliding portion. Also, the lubricating oil supplied to each sliding portion is discharged from the compression mechanism 17 through a space between the main shaft portion 71 and the main bearing 33, a cylinder chamber, or the like.

Here, the present embodiment has adopted the configuration in which the seal mechanism 37 for sealing between the rotating shaft 15 and the balancer cover 36 is provided between the rotating shaft 15 and the balancer cover 36 to be able to comply with the relative movement between the rotating shaft 15 and the balancer cover 36 in the axial direction;

According to this configuration, the seal mechanism 37 seals between the rotating shaft 15 and the balancer cover 36, so that leakage of the refrigerant in the balancer cover 36 into the sealed container 19 and entry of the lubricating oil contained in the sealed container 19 into the balancer cover 36 can be inhibited.

In particular, in the present embodiment, the seal mechanism 37 can comply with the relative movement between the balancer cover 36 and the rotating shaft 15 in the axial direction, and thus, regardless of the displacement of the rotating shaft 15 due to vibrations, pressure fluctuations, or the like, stable sealing performance can be ensured.

The present embodiment has adopted the configuration in which the seal mechanism 37 is interposed between the cover body 100 and the lid member 101 to be movable in the axial direction.

According to this configuration, a movement space (the lower space S2) for the seal mechanism 37 can be secured between the cover body 100 and the lid member 101. This makes it easier to cause the seal mechanism 37 to comply with the displacement of the rotating shaft 15 smoothly.

The present embodiment has adopted the configuration in which the seal mechanism 37 abuts the lower end face of the rotating shaft 15 while being pressed upward.

According to this configuration, regardless of the position of the rotating shaft 15 in the vertical direction, a close contact between the rotating shaft 15 and the seal mechanism 37 can be easily maintained. For that reason, it becomes easier to ensure the sealing performance between the rotating shaft 15 and the balancer cover 36.

The present embodiment has adopted the configuration in which the gap S1 between the stepped surface 105*c* and the thrust plate 130 communicates with the lower space S2 defined between the thrust plate 130 and the lid member 101.

According to this configuration, the refrigerant in the balancer cover 36 fills the gap S1 and the lower space S2 through the gap between the small diameter portion 105*b* and the rotating shaft 15. Accordingly, the pressure in the lower space S2 can be maintained at the same level as the pressure in the balancer cover 36. Thus, the thrust plate 130 can be pressed against the rotating shaft 15 also due to the pressure of the refrigerant. In addition, in the present embodiment, by using the V-packing for the seal member 132, the pressure of the refrigerant acts to separate the first piece and the second piece from each other in the axial direction. For that reason, it becomes easier to ensure the sealing performance between the thrust plate 130 and the rotating shaft 15.

The present embodiment has adopted the configuration in which the seal mechanism 37 includes the detent portions 131 that restrict the rotation of the thrust plate 130 with respect to the cover body 100.

According to this configuration, it is possible to inhibit unnecessary wear between the thrust plate 130 and the rotating shaft 15, so that the durability can be improved.

The present embodiment has adopted the configuration in which the seal member 132 is made of an elastically deformable material and interposed between the thrust plate 130 and the lid member 101, and the pressing member 133 is interposed between the thrust plate 130 and the lid member 101.

According to this configuration, the thrust plate 130 can be pressed against the rotating shaft 15 due to pressing forces of both the seal member 132 and the pressing member 133. Thus, it is possible to improve the sealing performance between the thrust plate 130 and the rotating shaft 15.

In the present embodiment, since the seal member 132 seals between the thrust plate 130 and the lid member 101 in the axial direction, wear and the like of the seal member 132 due to the vertical displacement of the rotating shaft 15 can be inhibited. Thus, the durability can be improved.

Since the refrigeration cycle device 1 of the present embodiment includes the rotary compressor 2 described above, it is possible to provide the refrigeration cycle device 1 that can improve operational reliability and compression performance over a long period of time.

Second Embodiment

Figure 4:
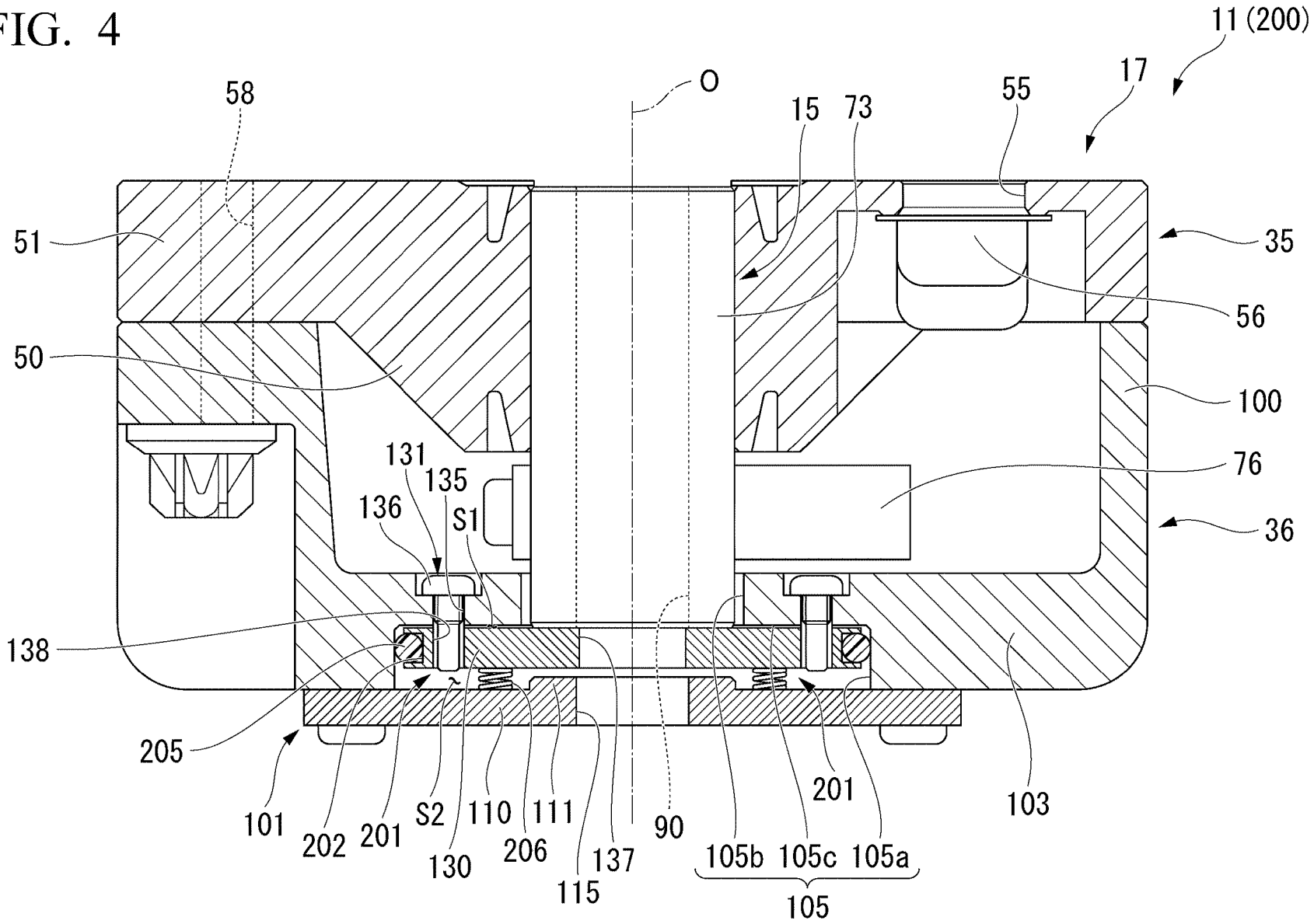
FIG. 4 is a partial cross-sectional view of a rotary compressor according to a second embodiment.

FIG. 4 is a partial cross-sectional view of a rotary compressor 200 according to a second embodiment.

In the rotary compressor 200 shown in FIG. 4, a groove 202 that opens outward in the radial direction is formed in the thrust plate 130 of the seal mechanism 201. The groove 202 is formed along the entire circumference of the thrust plate 130.

A seal member 205 is, for example, an O-ring. That is, the seal member 205 is a ring-shaped member made of an elastically deformable material and is formed in a circular shape in a cross-sectional view in the axial direction in its initial state (in a natural length state). The seal member 205 is fitted into the groove 202 described above. The seal member 205 is interposed between an outer circumference of the thrust plate 130 and the inner circumferential surface of the large diameter portion 105*a* in a radially crushed state. Thus, the seal member 205 seals between the thrust plate 130 and the cover body 100 in the radial direction. The seal member 205 slides on the inner circumferential surface of the large diameter portion 105*a* as the thrust plate 130 moves in the vertical direction.

The pressing member 206 is, for example, a coil spring. The pressing member 206 is interposed between the thrust plate 130 and the base plate 110. The pressing member 206 presses the thrust plate 130 upward. In addition, in the present embodiment, a plurality of pressing members 206 are disposed around the protruding portion 111 at intervals in the circumferential direction.

In the present embodiment, the same effects as those of the above-described embodiment are achieved, and for example, the following effect is achieved.

That is, by providing the seal member 205 and the pressing member 206 at different positions, a degree of freedom in designing the seal member 205 and the pressing member 206 can be improved.

Third Embodiment

Figure 5:
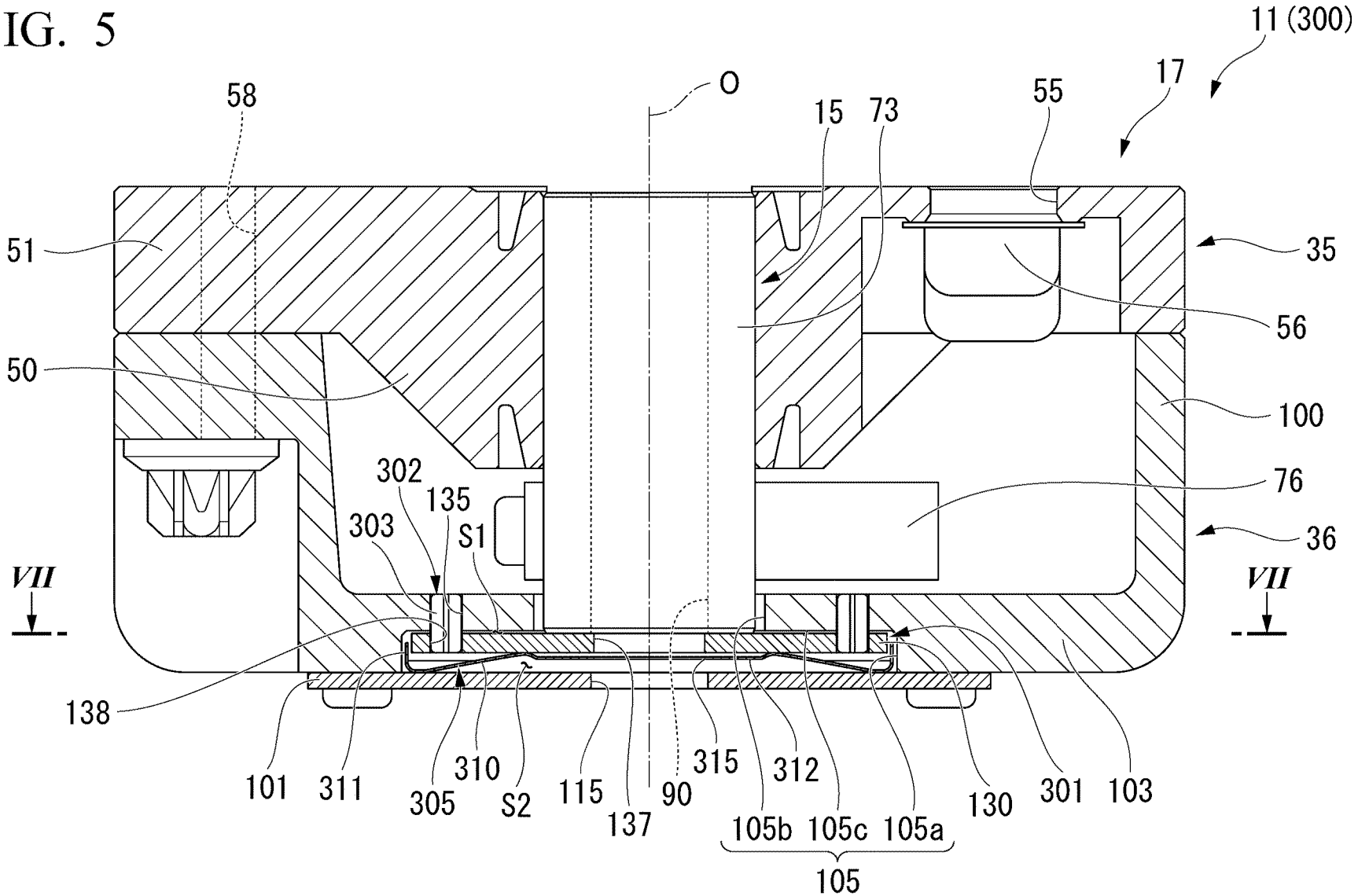
FIG. 5 is a partial cross-sectional view of a rotary compressor according to a third embodiment.

FIG. 5 is a partial cross-sectional view of a rotary compressor 300 according to a third embodiment.

In a seal mechanism 301 of the rotary compressor 300 shown in FIG. 5, a detent portion 302 has pins 303 provided on the bottom wall 103 of the cover body 100. The pins 303 are fixed by press fitting or the like in the through holes 135 formed in the bottom wall 103. Lower end portions of the pins 303 protrude in the large diameter portion 105*a*. The lower end portions of the pins 303 are inserted into the insertion holes 138 of the thrust plate 130 to restrict the circumferential movement of the thrust plate 130 relative to the cover body 100. Also, the pins 303 may be configured to be fixed to one member of the thrust plate 130 and the cover body 100 and be inserted (engaged) into the other member.

A pressing member 305 is a ring-shaped leaf spring made of a metal material or the like. Specifically, the pressing member 305 includes a movable piece 310, a restricting piece 311, and a bending piece 312.

The movable piece 310 is formed in a ring shape disposed coaxially with the axis O in a plan view. The movable piece 310 extends upward as it goes radially inward. An outer circumferential edge of the movable piece 310 abuts an upper surface of the lid member 101. On the other hand, an inner circumferential portion of the movable piece 310 abuts a portion of the lower surface of the thrust plate 130 located around the communication hole 137. The movable piece 310 is configured to be elastically deformable in the vertical direction starting from its outer circumferential edge.

The restricting piece 311 extends upward from the outer circumferential edge of the movable piece 310. An upper end portion of the restricting piece 311 enters between the inner circumferential surface of the large diameter portion 105*a* and the outer circumferential surface of the thrust plate 130. The restricting piece 311 restricts a radial movement of the pressing member 305 relative to the thrust plate 130 and the balancer cover 36 by coming into contact with the inner circumferential surface of the large diameter portion 105*a* or the outer circumferential surface of the thrust plate 130. Also, the restricting piece 311 may be provided in a portion of the movable piece 310 in the circumferential direction.

The bending piece 312 is formed on an inner side of the movable piece 310 in a ring shape in a plan view. Specifically, the bending piece 312 bends downward from an inner circumferential edge of the movable piece 310 (a contact portion with the thrust plate 130) and extends inward in the radial direction. An inner opening portion of the bending piece 312 constitutes a communication hole 315 that connects the inside of the supply path 90 to the inside of the supply hole 115.

In the present embodiment, the same effects as those of the above-described embodiments are achieved, and for example, the following effects are achieved.

That is, the pressing member 305 comes into contact with the lid member 101 and the thrust plate 130 in the axial direction, so that the gap between the balancer cover 36 and the rotating shaft 15 can be sealed. Thus, the number of components can be reduced as compared with the case in which the seal member and the pressing member are provided separately.

In addition, by using a metal material for the pressing member 305, heat resistance and the like can be improved, and the durability of the seal mechanism 301 can be improved as compared with the case in which a resin material or the like is interposed.

Figure 6:
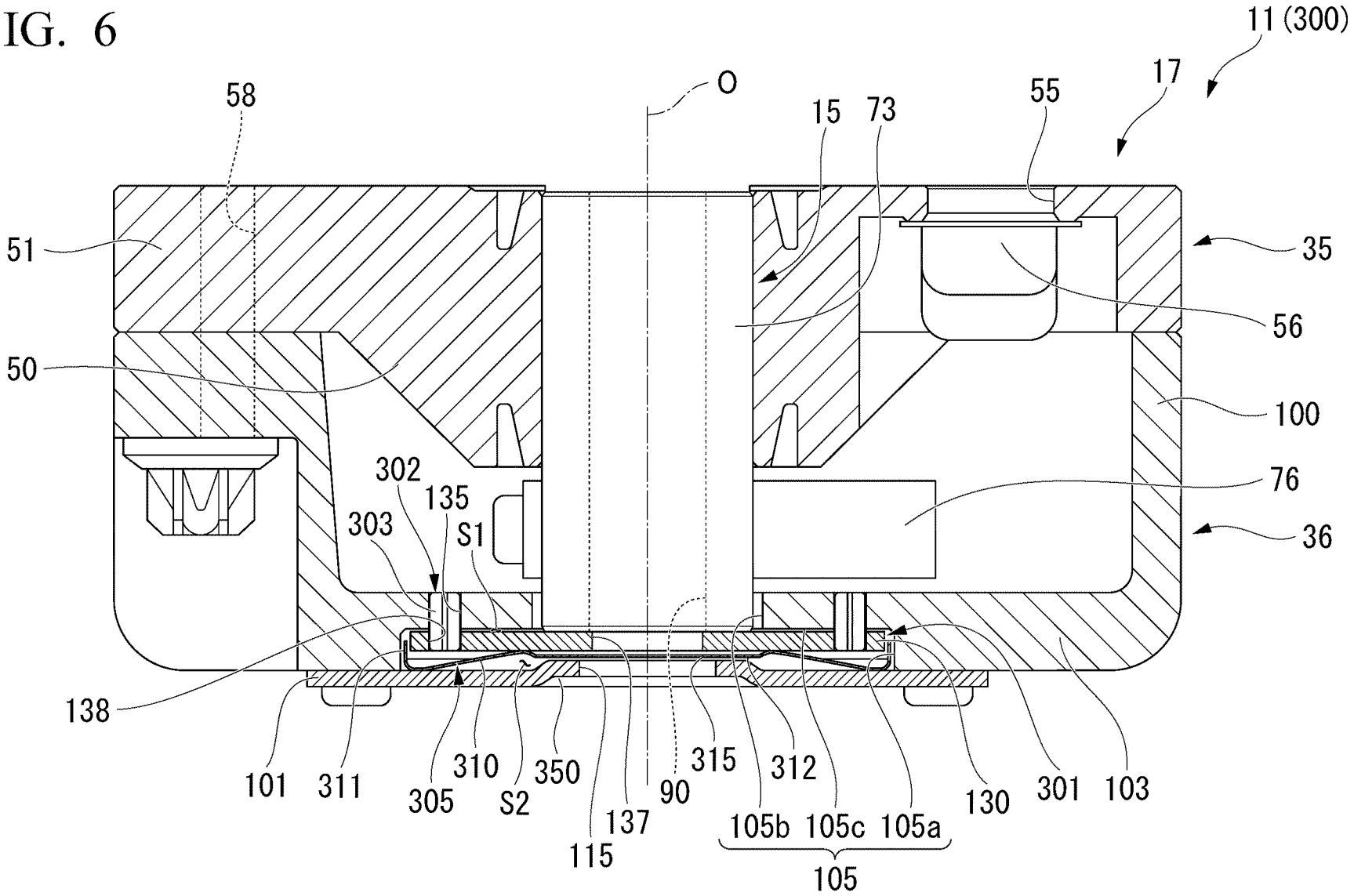
FIG. 6 is a partial cross-sectional view of a rotary compressor according to a modified example of the third embodiment.

Although the configuration in which the lid member 101 is formed in a flat plate shape has been described in the above-described embodiment, the present invention is not limited to this configuration. For example, as shown in FIG. 6, a bulging portion 350 that bulges upward may be formed in a portion of the lid member 101 that overlaps the bending piece 312 in a plan view. In this case, the bending piece 312 comes into contact with the bulging portion 350, and thus a downward displacement of the movable piece 310 is restricted. That is, an amount of displacement of the movable piece 310 can be adjusted due to a position of the bulging portion 350 in the axial direction.

Figure 7:
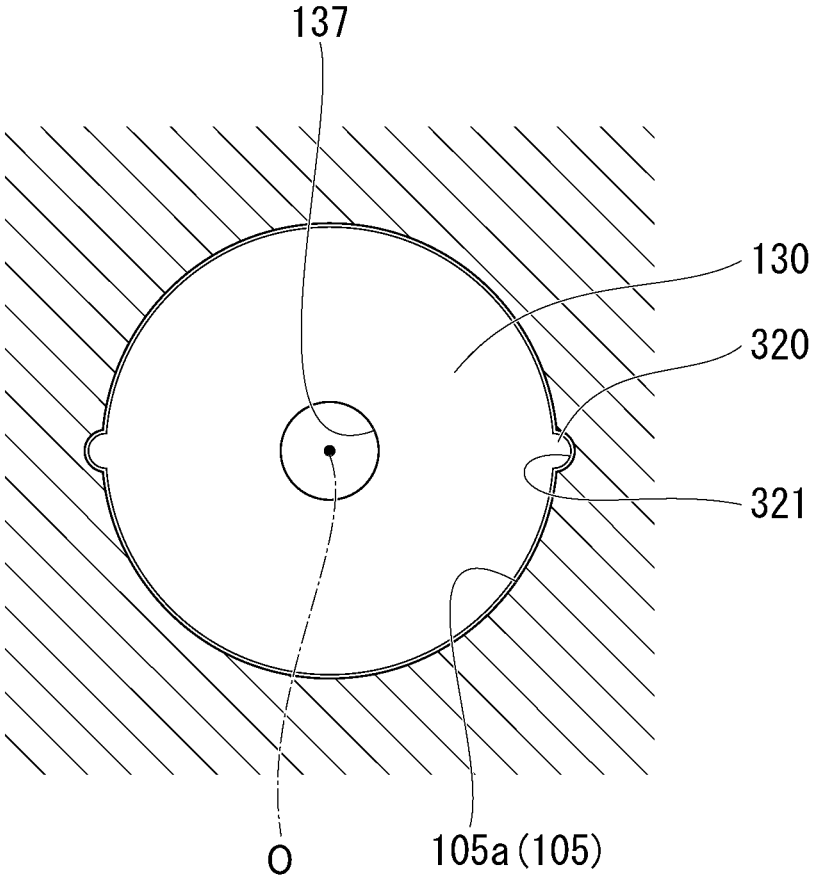
FIG. 7 is a cross-sectional view corresponding to line VII-VII in FIG. 5 in the rotary compressor according to the modified example of the third embodiment.

In the above-described embodiment, the detent portion is configured to protrude or recess in the axial direction, but the present invention is not limited to this configuration. For example, as shown in FIG. 7, protrusion portions 320 that protrude from the thrust plate 130 in the radial direction may be received in recessed portions 321 formed in the inner circumferential surface of the large diameter portion 105*a*.

Fourth Embodiment

Figure 8:
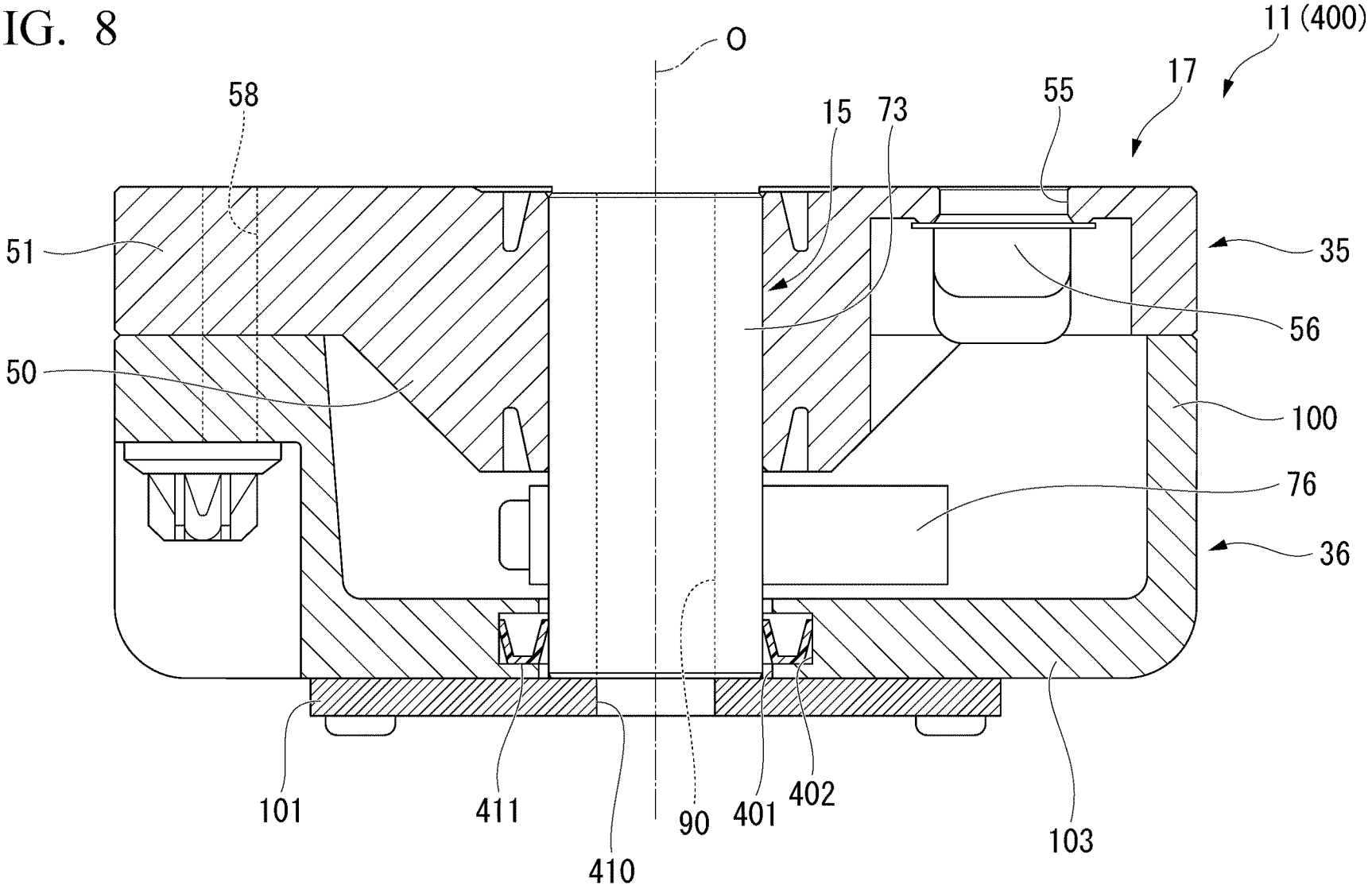
FIG. 8 is a partial cross-sectional view of a rotary compressor according to another configuration of a fourth embodiment.

FIG. 8 is a partial cross-sectional view of a rotary compressor 400 according to a fourth embodiment.

In the rotary compressor 400 shown in FIG. 8, an entrance hole 401 is formed in the bottom wall 103 of the cover body 100. The lower end portion of the rotating shaft 15 is inserted into the entrance hole 401. A recessed groove 402 is formed on an inner circumferential surface of the entrance hole 401 to be recessed outward in the radial direction. The recessed groove 402 extends along the entire circumference of the entrance hole 401 and opens on the inner circumferential surface of the entrance hole 401.

The lid member 101 is attached to the bottom wall 103 to cover the entrance hole 401 of the cover body 100 from below. The lower end face of the rotating shaft 15 abuts the upper surface of the lid member 101 from above. A supply hole 410 for opening the supply path 90 to the outside of the balancer cover 36 is formed at a portion of the lid member 101 that faces the supply path 90 in the axial direction.

A seal mechanism 411 of the present embodiment is, for example, a V-packing. The seal mechanism 411 is fitted into the recessed groove 402 while being open upward. A first piece of the seal mechanism 411 abuts a bottom surface of the groove 402, and a second piece thereof abuts the outer circumferential surface of the rotating shaft 15. Thus, the seal mechanism 411 seals between the balancer cover 36 and the rotating shaft 15 in the radial direction.

In the present embodiment, the same effects as those of the above-described embodiments are achieved, and the following effects are achieved.

That is, the second piece of the seal mechanism 411 slides on the outer circumferential surface of the rotating shaft 15 with the displacement of the rotating shaft 15. Thus, the gap between the balancer cover 36 and the rotating shaft 15 can be sealed while allowing the displacement of the rotating shaft 15 relative to the balancer cover 36.

In particular, since the seal mechanism 411 is configured only of the V-packing, reduction of the number of components can also be achieved.

Moreover, in the present embodiment, by using the V-packing that opens upward for the seal mechanism 411, the refrigerant pressure in the balancer cover 36 acts in directions in which the first piece and the second piece are separated from each other. Thus, the sealing performance between the balancer cover 36 and the rotating shaft 15 can be improved.

According to at least one embodiment described above, the rotating shaft, the electric motor, the compression mechanism, the balancer, and the balancer cover are provided. The rotating shaft has the eccentric portion. The electric motor is disposed on the first side of the rotating shaft in the axial direction and rotates the rotating shaft. The compression mechanism is disposed on the second side of the rotating shaft in the axial direction. The compression mechanism has the cylinder, the main bearing, and the sub-bearing. The main bearing is provided on the first side in the axial direction with respect to the cylinder. The sub-bearing is provided on the second side in the axial direction with respect to the cylinder. The balancer is provided on the rotating shaft on the second side of the sub-bearing in the axial direction.

The balancer cover covers the balancer. The lubricating oil supply path that opens on the second side end face in the axial direction is formed in the rotating shaft. In the balancer cover, the supply hole that allows the supply path to communicate with the outside of the balancer cover is formed at the position facing the supply path in the axial direction. The seal mechanism for sealing between the balancer cover and the rotating shaft is provided between the balancer cover and the rotating shaft while allowing the relative movement between the balancer cover and the rotating shaft in the axial direction.

According to this configuration, it is possible to ensure the sealing performance between the balancer cover and the rotating shaft.

Although several embodiments of the present invention have been described, these embodiments are presented as examples and are not intended to limit the scope of the invention. These embodiments can be implemented in various other forms, and various omissions, replacements, and modifications can be made without departing from the scope of the invention. These embodiments and their modified examples are included in the scope and spirit of the invention, as well as the scope of the invention described in the claims and equivalents thereof.

For example, in the above-described embodiments, the configuration in which the roller 62 and the vane 63 blade are separate members has been described, but the present invention is not limited to this configuration. For example, it may be a swing type in which a roller and a vane are integrated.

In the above-described embodiments, the three-cylinder compression mechanism 17 has been described as an example, but the present invention is not limited to this configuration. It may be a compression mechanism other than the three-cylinder type.

Further, in the plurality of embodiments described above, the cover body 100 has the detent portion 131 (or the pins 303) for restricting the movement of the thrust plate 130, and the stepped portion for fixing the detent portion 131 and the like, but the stepped portion may not be provided. That is, the large diameter portion 105*a* may be formed to pass through the cover body 100 without providing the stepped surface 105*c*, the small diameter portion 105*b*, the detent portion 131, and the like. In this case, the entire upper surface of the thrust plate 130 is exposed inside the cover body 100 through the large diameter portion 105*a*.

What is claimed is:

1. A rotary compressor comprising:

a rotating shaft including an eccentric portion;

an electric motor that is disposed on a first side of the rotating shaft in an axial direction thereof and rotates the rotating shaft;

a compression mechanism that is disposed on a second side of the rotating shaft in the axial direction and includes a cylinder, a main bearing provided on the first side in the axial direction with respect to the cylinder, and a sub-bearing provided on the second side in the axial direction with respect to the cylinder;

a balancer provided on the rotating shaft on the second side of the sub-bearing in the axial direction; and a balancer cover covering the balancer, wherein a lubricating oil supply path that opens on a second side end face in the axial direction is formed in the rotating shaft, a supply hole that allows the supply path to communicate with the outside of the balancer cover is formed in the balancer cover at a position facing the supply path in the axial direction, the balancer cover includes:

a cover body including an entrance hole into which a second side end portion of the rotating shaft in the axial direction enters; and a lid member that includes the supply hole at a position facing the entrance hole in the axial direction and is attached to the cover body from the second side in the axial direction, a seal mechanism includes:

an intermediate member that is interposed between the rotating shaft and the lid member and supported to be movable in the axial direction;

a detent portion that restricts rotation of the intermediate member relative to the balancer cover;

a seal member that is provided in the intermediate member and in close contact with either one of the cover body or the lid member; and a pressing member that presses the intermediate member and the lid member away from each other in the axial direction via the seal member, the seal mechanism seals between the balancer cover and the rotating shaft, and the seal mechanism is provided between the balancer cover and the rotating shaft while allowing relative movement between the intermediate member and the lid member which is a portion of the balancer cover, and the seal mechanism abuts the second side end face of the rotating shaft while being pressed toward the first side in the axial direction.

2. The rotary compressor according to claim 1, wherein the seal mechanism is interposed between the rotating shaft and the lid member on the second side in the axial direction with respect to the rotating shaft and is disposed to be movable in the axial direction.

3. The rotary compressor according to claim 1, wherein the seal member is a member having a V-shaped cross-section, in which an opening side of the V shape communicates with the inside of the balancer cover, and a closed side of the V shape communicates with the supply hole.

4. The rotary compressor according to claim 3, wherein the intermediate member abuts the second side end face of the rotating shaft in the axial direction with a gap between it and the cover body in the axial direction, and the gap communicates with a space defined by the intermediate member and the lid member.

5. The rotary compressor according to claim 3, wherein the seal member is made of an elastically deformable material and is in close contact with the intermediate member and the lid member in the axial direction.

6. The rotary compressor according to claim 3, wherein the seal member is interposed between an outer circumference of the intermediate member and the cover body and is configured to be slidable on the cover body as the intermediate member moves in the axial direction, and the seal mechanism includes a pressing member that presses the intermediate member and the lid member away from each other in the axial direction.

7. The rotary compressor according to claim 1, wherein the intermediate member abuts the second side end face of the rotating shaft in the axial direction with a gap between it and the cover body in the axial direction, and the gap communicates with a space defined by the intermediate member and the lid member.

8. The rotary compressor according to claim 7, wherein the seal member is made of an elastically deformable material and is in close contact with the intermediate member and the lid member in the axial direction.

9. The rotary compressor according to claim 7, wherein the seal member is interposed between an outer circumference of the intermediate member and the cover body and is configured to be slidable on the cover body as the intermediate member moves in the axial direction, and the seal mechanism includes a pressing member that presses the intermediate member and the lid member away from each other in the axial direction.

10. The rotary compressor according to claim 1, wherein the seal member is made of an elastically deformable material and is in close contact with the intermediate member and the lid member in the axial direction, and the seal mechanism includes a pressing member that presses the intermediate member and the lid member away from each other in the axial direction via the seal member.

11. The rotary compressor according to claim 1, wherein the seal member is interposed between an outer circumference of the intermediate member and the cover body and is configured to be slidable on the cover body as the intermediate member moves in the axial direction, and the seal mechanism includes a pressing member that presses the intermediate member and the lid member away from each other in the axial direction.

12. The rotary compressor according to claim 1, wherein the seal mechanism is slidably held on an outer circumferential surface of the rotating shaft in the entrance hole.

13. A refrigeration cycle device comprising:

the rotary compressor according to claim 1;

a radiator connected to the rotary compressor;

an expansion device connected to the radiator; and an evaporator connected between the expansion device and the rotary compressor.

* * * * *